US009903011B2

(12) United States Patent
Sato et al.

(10) Patent No.: US 9,903,011 B2
(45) Date of Patent: Feb. 27, 2018

(54) NI-BASED HEAT-RESISTANT SUPERALLOY AND METHOD FOR PRODUCING THE SAME

(71) Applicant: HITACHI METALS, LTD., Tokyo (JP)

(72) Inventors: Jun Sato, Yasugi (JP); Shinichi Kobayashi, Yasugi (JP); Tomonori Ueno, Yasugi (JP); Takehiro Ohno, Yasugi (JP); Chuya Aoki, Yasugi (JP); Eiji Shimohira, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 288 days.

(21) Appl. No.: 14/780,230

(22) PCT Filed: Mar. 25, 2014

(86) PCT No.: PCT/JP2014/058193

§ 371 (c)(1),
(2) Date: Dec. 10, 2015

(87) PCT Pub. No.: WO2014/157144

PCT Pub. Date: Oct. 2, 2014

(65) Prior Publication Data

US 2016/0108506 A1 Apr. 21, 2016

(30) Foreign Application Priority Data

Mar. 28, 2013 (JP) ..... 2013-068375
Sep. 27, 2013 (JP) ..... 2013-201390
Sep. 27, 2013 (JP) ..... 2013-201391

(51) Int. Cl.
*C22F 1/10* (2006.01)
*C22C 19/05* (2006.01)

(52) U.S. Cl.
CPC ..... *C22F 1/10* (2013.01); *C22C 19/05* (2013.01); *C22C 19/056* (2013.01)

(58) Field of Classification Search
CPC ..... C22F 1/10
See application file for complete search history.

(56) References Cited

U.S. PATENT DOCUMENTS 4,083,734 A 4/1978 Boesch
4,371,404 A 2/1983 Duhl et al.
(Continued)

FOREIGN PATENT DOCUMENTS

CN 85102029 A 1/1987
CN 101948969 A 1/2011
(Continued)

OTHER PUBLICATIONS

Office Action corresponding to Chinese Application No. 201480030177.4 dated Sep. 2, 2016.
(Continued)

*Primary Examiner* — Jessee Roe
(74) *Attorney, Agent, or Firm* — Myers Bigel, P.A.

(57) ABSTRACT

There is provided a method for producing a Ni-based heat-resistant superalloy a primary γ' phase with an average particle size of at least 500 nm comprising the steps of: providing a material to be hot-worked having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% B, 0.001 to 0.1% Zr, and the balance of Ni with inevitable impurities; heating the material to be hot-worked in a temperature having a range of 1,130 to 1,200° C. for at least 2 hours; cooling the material to be hot-worked heated by the heating step to a hot working temperature or less at a cooling rate of at most 0.03°
(Continued)

C./second; and subjecting the material to be hot-worked to hot working after the cooling step.

8 Claims, 3 Drawing Sheets

(56) References Cited

U.S. PATENT DOCUMENTS

| | | | |
|---|---|---|---|
| 4,574,015 | A | 3/1986 | Genereux et al. |
| 2003/0041930 | A1 | 3/2003 | DeLuca et al. |
| 2008/0260570 | A1 | 10/2008 | Harada et al. |
| 2011/0194971 | A1 | 8/2011 | Harada et al. |

FOREIGN PATENT DOCUMENTS

| | | | |
|---|---|---|---|
| JP | 2011-236450 | | 11/2011 |
| WO | WO 2006/059805 | A1 | 6/2006 |
| WO | WO 2011/062231 | A1 | 5/2011 |

OTHER PUBLICATIONS

Fahrmann et al. "Effect of Cooling Rate on Gleeble Hot Ductility of Udiment Alloy 720 Billet" *TMS* pp. 311-316 (2008).
International Search Report corresponding to International Application No. PCT/JP2014/058193 dated Jul. 1, 2014.

20μm

20μm

25μm

NI-BASED HEAT-RESISTANT SUPERALLOY AND METHOD FOR PRODUCING THE SAME

RELATED APPLICATIONS

This application is a 35 U.S.C. § 371 national phase application of PCT Application PCT/JP2014/058193 filed Mar. 25, 2014 which claims priority to Japanese Application No. 2013-068375 filed Mar. 28, 2013, Japanese Application No. 2013-201390 filed Sep. 27, 2013, and Japanese Application No. 2013-201391 filed Sep. 27, 2013. The entire contents of each are incorporated herein by reference in its entirety.

TECHNICAL FIELD

The present invention relates to a Ni-based heat-resistant superalloy and a method for producing the same.

BACKGROUND ART

A γ' (gamma prime) phase precipitation strengthened Ni-based alloy, which contains large amounts of alloy elements such as Al and Ti, has been applied to heat-resistant members for aircraft engines and gas turbines for power generation.

In particular, turbine disks among turbine components require high strength and high reliability, to which a Ni-base forged alloy has been applied. The term "forged alloy" is used in contrast to the term "cast alloy", which is a term for an alloy to be used with its casting solidification structure, and is a material produced by a process of hot working an ingot obtained by melting and solidification so that the ingot has a desired shape of a component. Due to the hot working, a coarse and heterogeneous cast and solidified structure is turned into a fine and homogeneous forged structure, and thereby mechanical characteristics such as the tensile strength and fatigue properties are improved. However, if too many γ' phases that are a strengthened phase exist in the structure, it may become difficult to carry out hot working represented by press forging, which may cause defects during production. In order to prevent this, the content of components of the composition of a forged alloy, such as Al and Ti, which contribute to the strengthening, is generally more limited than that in a cast alloy that is not subjected to hot working. Udimet 720 Li ("Udimet" is a registered trademark of Special Metals Corporation) can be mentioned as a turbine disk materials having the highest strength at the present, and in the material, the amounts of Al and Ti are 2.5% by mass and 5.0% by mass, respectively.

To improve the material strength, a process of producing a Ni-based alloy by using a powder metallurgy method has been implemented, instead of a conventional process of melting an ingot. According to this method, the alloy composition can include a larger amount of above-described strengthening elements compared with an alloy obtained by a melting and forging method. However, to prevent contamination by impurities, it is inevitable to perform high-level management of the production processes, and thus, the production costs may be high, and therefore, this production method is used for limited purposes.

As described above, forged alloys used in turbine disks have a great problem of simultaneously realizing high strength and high hot workability, and thus, alloy compositions and production methods that can solve this problem have been developed.

For example, WO 2006/059805 A discloses an extremely strong alloy that can be produced by a conventional melting and forging method. A composition of this alloy contains a larger amount of Ti than the composition of Udimet 720 Li and additionally contains a large amount of Co, thus enhancing the stability of its structure and also enabling it to be hot worked.

There has been another attempt to improve the hot workability by a production method. "Proceedings of the 11th International Symposium on Superalloys" (TMS, 2008), pp. 311-316, discloses an experimental report regarding a forged member of Udimet 720 Li, in which the hot workability is more improved as a cooling rate decreased when the material was cooled from a raised temperature of 1,110° C.

CITATION LIST

Patent Document

[Patent Document 1] WO 2006/059805 A

Non-Patent Document

[Non-Patent Document 1] "Proceedings of the 11th International Symposium on Superalloys" (TMS, 2008), pp. 311-316

SUMMARY OF INVENTION

Technical Problem

The alloy disclosed in the above Patent Document had very superior characteristics as a forged alloy, but the temperature range in which it can be worked is narrow, and thus, the alloy needs to be hot-worked with quantity of small working in processing per once, and as a result, it is presumed that a production process is necessary in which working and reheating are repeated many times. If the hot workability can be improved, the time and energy required for production can be reduced. In addition, an alloy material having a shape closer to the final product can be obtained, and thereby the yield of the material also improves.

Furthermore, although the knowledge disclosed in the above Non-Patent Document such that the hot workability is improved by changing the heat treatment conditions is important, but the evaluation made in the Non-Patent Document is an evaluation for the material of which the structure has already been homogenized after undergoing hot working. Under these circumstances, a method for improving the hot workability at an initial working stage at which it is more difficult to perform working, i.e., at the stage of hot-working an ingot having a heterogeneous cast and solidified structure, is still desired.

An object of the present invention is to provide a Ni-based heat-resistant superalloy having strength high enough to be used in aircraft engines, power generator gas turbines and also having excellent hot workability and a production method therefor.

Solution to Problem

The inventors of the present invention have examined methods for producing alloys with a variety of structures and have found that the hot workability can be greatly improved by selecting an appropriate heating process and controlling particle sizes of γ' phases which are strengthened phases.

According to an aspect of the present invention, there is provided a method for producing a Ni-based heat-resistant superalloy, the method including the steps of: providing a material to be hot-worked having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% B, 0.001 to 0.1% Zr, and the balance of Ni with inevitable impurities; heating the material to be hot-worked in a temperature having a range of 1,130 to 1,200° C. for at least 2 hours; cooling the material to be hot-worked heated by the heating step to a hot working temperature or less at a cooling rate of at most 0.03° C./second; and subjecting the material to be hot-worked to hot working after the cooling step.

This method may further include a second heating step for heating the material to be hot-worked in a temperature that has a range of 950 to 1,160° C. and is lower than the temperature performed by the first heating step for at least 2 hours after or during the cooling step.

The material to be hot-worked may have a composition consisting of, by mass, 0.005 to 0.04% C, 1.5 to 3.0% Al, 5.5 to 6.7% Ti, 13 to 16% Cr, 20 to 27% Co, 2.0 to 3.5% Mo, 0.7 to 2.0% W, 0.005 to 0.04% B, 0.005 to 0.06% Zr, and the balance of Ni with inevitable impurities.

The material to be hot-worked may have a composition consisting of, by mass, 0.005 to 0.02% C, 2.0 to 2.5% Al, 6.0 to 6.5% Ti, 13 to 14% Cr, 24 to 26% Co, 2.5 to 3.2% Mo, 1.0 to 1.5% W, 0.005 to 0.02% B, 0.010 to 0.04% Zr, and the balance of Ni with inevitable impurities.

According to another aspect of the present invention, there is provided a Ni-based heat-resistant superalloy having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% 13, 0.001 to 0.1% Zr, and the balance of Ni with inevitable impurities and having a primary γ' phase with an average size of at least 500 nm in diameter.

The average size in diameter of the primary γ' phase is preferably at least 1 μm.

The Ni-based heat-resistant superalloy may have a composition consisting of, by mass, 0.005 to 0.04% C, 1.5 to 3.0% Al, 5.5 to 6.7% Ti, 13 to 16% Cr, 20 to 27% Co, 2.0 to 3.5% Mo, 0.7 to 2.0% W, 0.005 to 0.04% B, 0.005 to 0.06% Zr, and the balance of Ni with inevitable impurities.

The Ni-based heat-resistant superalloy may have a composition consisting of, by mass, 0.005 to 0.02% C, 2.0 to 2.5% Al, 6.0 to 6.5% Ti, 13 to 14% Cr, 24 to 26% Co, 2.5 to 3.2% Mo, 1.0 to 1.5% W, 0.005 to 0.02% B, 0.010 to 0.04% Zr, and the balance of Ni with inevitable impurities.

According to yet another aspect of the present invention, there is provided a method for producing a Ni-based heat-resistant superalloy, the method including the steps of: heating an ingot having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% B, 0.001 to 0.1% Zr, and the balance of Ni with inevitable impurities in a hot working temperature having a range of 800 to 1,125° C. and subjecting the resulting ingot to first hot working at a hot working ratio of 1.1 to 2.5 to provide a hot-worked material; reheating the hot-worked material in a temperature range that is higher than the temperature performed at the first hot working and is lower than a γ' phase solvus temperature to provide a reheated material; cooling the reheated material to a temperature having a range of 700 to 1,125° C. at a cooling rate of at most 0.03° C./second; and performing second hot working after the cooling step.

The ingot may have a composition consisting of, by mass, 0.005 to 0.04% C, 1.5 to 3.0% Al, 5.5 to 6.7% Ti, 13 to 16% Cr, 20 to 27% Co, 2.0 to 3.5% Mo, 0.7 to 2.0% W, 0.005 to 0.04% B, 0.005 to 0.06% Zr, and the balance of Ni with inevitable impurities.

The ingot may have a composition consisting of, by mass, 0.005 to 0.02% C, 2.0 to 2.5% Al, 6.0 to 6.5% Ti, 13 to 14% Cr, 24 to 26% Co, 2.5 to 3.2% Mo, 1.0 to 1.5% W, 0.005 to 0.02% B, 0.010 to 0.04% Zr, and the balance of Ni with inevitable impurities.

The temperature for the reheating step may have a range of 1,135° C. to 1,160° C.

Advantageous Effects of Invention

According to the present invention, the hot workability of a highly strong alloy, for which it is difficult to perform hot working or a long time and a large amount of energy is required for the hot working if the prior art is used, can be improved by appropriately managing the temperature of the stock at the time of the production thereof, and thereby a Ni-based heat-resistant superalloy having a strength high enough to be used for aircraft engines, power generation gas turbines, and the like, and having excellent hot workability and a production method therefor can be provided.

In addition, according to the present invention, the energy and time required for working can be reduced compared with the conventional production method, and thereby the material yield can be improved. Furthermore, the alloy of the present invention has a strength higher than that of conventionally used alloys, and thus, if the alloy of the present invention is used for heat engines described above, the operation temperature of the engines can be increased, and therefore, it is expected that the alloy of the present invention can contribute to increased efficiency of heat engines.

Furthermore, an object of hot working is to obtain a homogeneous recrystallized structure by repeating heating and working onto a heterogeneous cast structure in addition to imparting a shape to the material. However, the Ni-based heat-resistant superalloy having the above-described composition has a very high strength, and thus, cracks and laps may easily occur during working even if the amount of strain is small, and therefore, it is difficult to impart the strain by the amount required for recrystallization, and thus the working cannot be continuously performed. According to the present invention, in such a very strong member, the stock temperature is appropriately managed, and in addition, the amount of deformation during the production is managed, and thereby excellent hot workability can be realized.

DESCRIPTION OF EMBODIMENTS

Figure 1A:
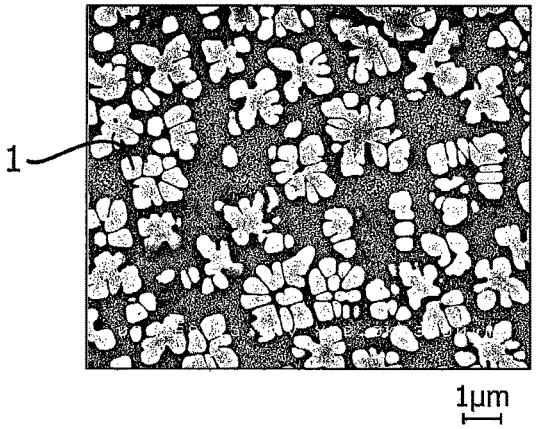
FIG. 1 is two electron microscope photographs showing metal structures of an Example of a Ni-based heat-resistant superalloy according to the present invention and a Comparative Example.

Embodiments of a Ni-based heat-resistant superalloy and a method for producing the same according to the present invention will be described below.

First, regarding alloy elements in compositions of a material to be hot-worked or an ingot of a Ni-based heat-resistant superalloy, each of the content ranges of the alloy elements and the reasons therefor will be described. The content ranges are based on % by mass.

C: 0.001 to 0.05%

C has an effect of increasing the strength of the grain boundary. This effect is exhibited with the content of 0.001% or higher, but if the content of C is excessively high, coarse carbides are formed, and thereby the strength and the hot workability may degrade. Accordingly, an upper limit of the content of C is 0.05%. A range of the content of C is preferably 0.005 to 0.04%, more preferably 0.005 to 0.02%.

Cr: 12 to 18%

Cr is an element that improves the resistance to oxygen and corrosion. To obtain this effect, it is necessary that the content thereof be 12% or higher. If the content of Cr is excessively high, an embrittled phase such as a σ phase is formed, and thereby, the strength and the hot workability may be degraded, and thus an upper limit of the content of Cr is 18%. A range of the content of Cr is preferably 13 to 16%, more preferably 13 to 14%.

Co: 14 to 27%

Co improves the structure stability, and if an alloy contains a large amount of Ti, which is a strengthening element, enables maintenance of the hot workability of the alloy. To obtain this effect, it is necessary that the content of Co be 14% or higher. The hot workability improves as the content of Co increases. However, if the content of Co is excessively high, detrimental phases such as a σ phase or an η phase are formed, and thereby, the strength and hot workability may be degraded, and thus an upper limit of the content of Co is 27%. From the viewpoint of both the strength and the hot workability, a range of the content of Co is preferably 20 to 27%, more preferably 24 to 26%.

Al: 1.0 to 4.0%

Al is an essential element that forms a γ' ($Ni_3Al$) phase, which is a strengthened phase, and improves the high-temperature strength. To obtain the effect, it is necessary that the content of Al be at least 1.0%, but if an excessively large amount of Al is charged, the hot workability may be degraded, which may cause material defects such as crack during working. Accordingly, the content of Al is limited to within a range of 1.0 to 4.0%. The range of the content of Al is preferably 1.5 to 3.0%, more preferably 2.0 to 2.5%.

Ti: 4.5 to 7.0%

Similar to Al, Ti is an essential element that forms a γ' phase, solution-strengthens the γ' phase, and thus, increases the high-temperature strength. To obtain the effect, it is necessary that the content of Ti be at least 4.5%; however, if an excessively large amount of Ti is charged, then the temperature of the γ' phase becomes high and the γ' phase may become unstable, the grains may become coarse, a detrimental phase such as an η (eta) phase may be formed, which thereby impairs the hot workability. Accordingly, an upper limit of the content of Ti is 7.0%. A range of the content of Ti is preferably 5.5 to 6.7%, and more preferably 6.0 to 6.5%.

Mo: 1.5 to 4.5%

Mo has an effect of contributing to solution-strengthening of the matrix and of improving the high-temperature strength. To obtain this effect, it is necessary that the content of Mo be 1.5% or higher, but if the content of Mo is excessively high, an intermetallic compound phase is formed, which may impair the high-temperature strength. Accordingly, an upper limit of the content of Mo is 4.5%. A range of the content of Mo is preferably 2.0 to 3.5%, more preferably 2.5 to 3.2%.

W: 0.5 to 2.5%

Similar to Mo, W is an element that contributes to solution-strengthening of the matrix, and it is necessary that the content of W is 0.5%. If the content of W is excessively high, a detrimental intermetallic compound phase is formed, which may impair the high-temperature strength. Accordingly, an upper limit of the content of W is 2.5%. A range of the content of W is preferably 0.7 to 2.0%, and more preferably 1.0 to 1.5%.

B: 0.001 to 0.05%

B is an element that improves the grain boundary strength and improves the creep strength and the ductility. To obtain this effect, it is necessary that the content of B be at least 0.001%. In contrast, B has a strong effect of lowering the melting point. Furthermore, if any coarse boride is formed, the workability is inhibited. Accordingly, it is necessary that the content of B be controlled so as not to exceed 0.05%. The range of the content of B is preferably 0.005 to 0.04, and more preferably 0.005 to 0.02%.

Zr: 0.001 to 0.1%

Similar to B, Zr has an effect of improving the grain boundary strength, and to obtain this effect, it is necessary that the content of Zr be at least 0.001%. In contrast, if the content of Zr is excessively high, the melting point may drop, and thereby the high-temperature strength may be degraded and the hot workability may be inhibited. Accordingly, an upper limit of the content of Zr is 0.1%. A range of the content of Zr is preferably 0.005 to 0.06%, more preferably 0.010 to 0.04%.

In the composition of the Ni-based heat-resistant superalloy or a material to be hot-worked or an ingot, portions other than the portions of the above-described elements include Ni and inevitable impurities.

Next, regarding embodiments of a method for producing a Ni-based heat-resistant superalloy according to the present invention, each of the steps and the conditions therefor will be described.

1. First Embodiment of Production Method

Preparation Step

A material to be hot-worked having the composition discussed above can be produced by vacuum melting, which is a conventional method for producing a Ni-based heat-resistant superalloy. By this method, oxidation of active elements such as Al and Ti can be suppressed, and thereby inclusions can be reduced. To obtain a higher-grade ingot, secondary or tertiary melting such as electroslag remelting and vacuum arc remelting may be carried out.

An intermediate material that has been preliminarily worked after the melting by working such as hammer forging, press forging, rolling, and extrusion may be used as the material to be hot-worked.

First Heating Step

The first heating step is capable of improving the hot workability by alleviating solidification segregation that may occur during casting. In addition, this first heating step has an effect of softening the material by solutionizing precipitates such as the γ' phase. The first heating step also has an effect such that if the material to be hot-worked is an intermediate material, working strain imparted by the preliminary working is eliminated by the first heating step, and thereby, subsequent working can be easily carried out.

These effects become remarkable by holding the material at 1,130° C. or higher, which is the temperature at which atoms are actively diffused in the material. If the retention temperature in the first heating step is excessively high, it is likely that incipient melting will occur, which may cause cracking during subsequent hot working, and thus, an upper limit of the retention temperature is 1,200° C. A lower limit of the retention temperature is preferably 1,135° C., more preferably 1,150° C. An upper limit of the retention temperature is preferably 1,190° C., more preferably 1,180° C.

To obtain the above-described effect, it is necessary that the retention time be at least 2 hours. A lower limit of the retention time is preferably 4 hours, more preferably 10 hours according to the volume of the material to be hot-worked, and yet more preferably 20 hours. An upper limit of the retention time is not particularly limited; however, the effect may be saturated if the retention time exceeds 48 hours and factors that inhibit the characteristics of the present invention may be generated, and to prevent them, the retention time may be 48 hours.

Cooling Step

In the first heating step mentioned above, the γ' phase is solutionized in the matrix, and if the cooling rate is high in the cooling treatment performed after the heating, a fine γ' phase may precipitate, and thereby, the hot workability may remarkably degrade. To prevent this, it is necessary that the material be cooled to a predetermined hot working temperature at a cooling rate of at most 0.03° C./second. The γ' phase is allowed to grow during this cooling, and thus, the precipitation of fine γ' phase can be suppressed to obtain excellent hot workability.

The γ' phase grows more and the particle size becomes greater as the cooling rate is decreased, and thus, the lower the cooling rate becomes, the more advantageous it is in improving the hot workability. The cooling rate is preferably at most 0.02° C./second, and more preferably at most 0.01° C./second. The cooling rate is not particularly limited by a lower limit; however, to prevent coarsening of the γ matrix grains, a lower limit of the cooling rate may be set at 0.001° C./second.

Considering the efficiency of the production process, it is desirable to cool the material at a cooling rate of at most 0.03° C./second until a predetermined hot working temperature is achieved and hot working is carried out in this state; however, the present invention is not limited to this. Specifically, the hot working may be carried out by cooling the material down to room temperature and then increasing the material temperature to a predetermined hot working temperature again. In this step, a cooling rate from the predetermined hot working temperature to room temperature may be the cooling rate of at most 0.03° C./second specified above, or alternatively, it may be higher than the specified cooling rate.

Hot Working Step

After having undergone the above-described steps, the Ni-based heat-resistant superalloy has a coarsely precipitated γ' phase and the hot workability of the material itself is thus improved. Accordingly, excellent hot workability can be obtained regardless of the method of the working. Examples of the hot working methods include forging such as hammer forging and press forging, rolling, and extrusion. As a working method of obtaining a material for aircraft engines and gas turbine disks, hot-die forging and superplastic forging can be applied. A temperature range during the hot working step is preferably 1,000 to 1,100° C.

Second Heating Step

In the production method according to the present invention, a second heating step, in which the material to be hot-worked is retained within a range of temperature lower than the retention temperature in the first heating step and within a range of 950 to 1,160° C. for at least 2 hours, may be optionally carried out after or in the middle of the above-described cooling treatment.

The second heating step is intended to allow the γ' phase that grows during the cooling treatment to grow more. By carrying out the second heating step before the hot working superior hot workability can be obtained. To obtain this effect, it is preferable to retain the material at the above-described temperature for at least 4 hours. If the retention temperature in the second heating step is less than 950° C., the γ' phase may not sufficiently grow due to the slow diffusion rate, and thus, the hot workability may not be expected to further improve. In contrast, if the retention temperature exceeds 1,160° C., then the γ' phase having been coarsely precipitated in the cooling treatment is solutionized again. Therefore, the hot workability may not be expected to further improve. A lower limit of the retention temperature is preferably 980° C., more preferably 1,100° C. An upper limit of the retention temperature is preferably 1,155° C., more preferably 1,150° C. In addition, if the retention time is less than 2 hours, further growth of the γ' phase becomes insufficient. Because the second heating step is intended to realize further growth of the γ' phase, an upper limit of the retention time is not particularly limited. However, considering the size and the productivity of the γ' phase that grows in the second heating step, the retention time may be actually about 5 to 60 hours.

The second heating step is carried out at a temperature lower than the temperature applied in the first heating step. For example, the temperature in the second heating step is lower than the temperature in the first heating step by 10° C. or more, more preferably by 30° C. or more. If the retention temperature in the second heating step is higher than the predetermined hot working temperature, the material is cooled down to the predetermined hot working temperature at a cooling rate of at most 0.03° C./second. In addition, the second heating step can be carried out not only onto a material to be hot-worked that has been cooled down to the predetermined hot working temperature in the cooling treatment but also onto a material to be hot-worked that has been cooled to the predetermined hot working temperature or lower or to room temperature. Furthermore, the second heating step can also be performed on a material to be hot-worked that has been cooled to a temperature higher than the predetermined hot working temperature in the cooling treatment. In this case, the material to be hot-worked having undergone the second heating step is cooled down to the predetermined hot working temperature at a cooling rate of at most 0.03° C./second, and the cooling treatment is continuously performed.

In the Ni-based heat-resistant superalloy obtained by performing the above-described preparation step, the first heating step, and the cooling treatment, the γ' phase precipitated during the cooling (primary γ' phase) is allowed to grow, and thereby, excellent hot workability is obtained. The Ni-based heat-resistant superalloy having the excellent hot workability acquires a characteristic metal structure acquired after undergoing the cooling treatment. Specifically, the Ni-based heat-resistant superalloy having excellent hot workability acquires a structure in which a primary γ' phase of 500 nm or greater may be precipitated. More preferably, the Ni-based heat-resistant superalloy acquires a structure in which a primary γ' phase of 1 μm or greater may be precipitated. This characteristic metal structure will be described in more detail with reference to the following Examples.

2. Second Embodiment of Production Method

Preparation Step

The ingot having the above-described composition that is used in the present embodiment can be obtained by vacuum melting similarly to other Ni-based heat-resistant superalloys. Thus, oxidation of active elements such as Al and Ti can be suppressed and inclusions can be reduced. To obtain a higher-grade ingot, secondary or tertiary melting such as electroslag remelting and vacuum arc remelting may be carried out.

The ingot obtained by melting may undergo homogenization heat treatment in order to reduce solidification segregation that inhibits the hot workability. For the homogenization heat treatment, the ingot may be retained at a temperature ranging from 1,130 to 1,200° C. for 2 hours or more and then slowly cooled to form a coarse γ' phase.

If the γ' phase has not grown sufficiently during the slow cooling after the homogenization heat treatment described above, in order to further coarsen the γ' phase and improve the hot workability, the ingot having undergone the homogenization heat treatment at a temperature ranging from 950 to 1,160° C. for 2 hours or more, the heated ingot may be subjected to the second heating step at the cooling rate of at most 0.03° C./second.

First Hot Working Step

A first hot working step is performed, in which the above-described ingot is hot-worked to obtain a hot-worked material. The temperature for the hot working in this step is in a range of 800 to 1,125° C. The temperature is controlled within a range of 800 to 1,125° C. in order to partially solutionize the γ' phase which is the strengthened phase in a parent phase and to thereby reduce the resistance to deformation of the material. If the temperature is lower than 800° C., the resistance to deformation of the material is high, and thus, sufficiently high hot workability cannot be obtained. In contrast, if the temperature is higher than 1,125° C., it is likely that incipient melting occurs. A lower limit of the temperature for the hot working in this step is preferably 900° C., more preferably 950° C. An upper limit of the temperature for the hot working in this step is preferably 1,110° C., more preferably 1,100° C.

In an ingot of general Ni-based heat-resistant superalloys such as Waspaloy (registered trademark) and 718 alloy, for example, the strain is eliminated due to recrystallization during the working by the hot working step or during the retention in the working temperature range performed after the working, and thus, working can be continuously performed, but in the ingot having the composition specified by the present embodiment, recrystallization in the above-described temperature range for the hot working hardly occurs, and thus, the workability is not expected to be restored. Accordingly, in order to cause recrystallization in the subsequent reheating step, the ingot is deformed in this step at a hot working ratio ranging from 1.1 to 2.5. The term "hot working ratio" refers to a ratio determined by dividing the section of the material in a direction normal to the direction in which the material extends before the hot working such as forging is carried out by the section of the material in a direction normal to the direction in which the material extends after the hot working is done. If the hot working ratio is less than 1.1, the material is not sufficiently recrystallized in the next reheating step, and thus, the workability is not improved. If the hot working ratio is greater than 2.5, it is likely that cracking will occur. A lower limit of the hot working ratio is preferably 1.2, and more preferably 1.3. An upper limit of the hot working ratio is preferably 2.2, and more preferably 2.0. For the hot working in this step, hot working methods such as hammer forging, press forging, rolling, and extrusion may be applied.

Reheating Step

The hot-worked material having been imparted with working strains in the first hot working step is reheated to a temperature in a range higher than the temperature in the first hot working step and lower than a γ' phase solvus temperature to obtain a reheated material. In this reheating step, recrystallization occurs, the strain is eliminated, and the structure changes from the coarsely cast structure to a fine hot-worked structure, and the hot workability is thereby improved. The temperature range for the reheating step is higher than the temperature for the hot working step because if the temperature range for the first hot working is applied, sufficient recrystallization may not occur, and thus, the workability may not be improved, as described above. The temperature range for the reheating step is lower than the γ' phase solvus temperature because if the temperature in the reheating step exceeds the γ' phase solvus temperature, the grains of γ matrix may become coarse, although recrystallization occurs, and thus, a sufficient effect of improving the workability cannot be obtained. In addition, it is disadvantageous in realizing a fine structure in a final product if the temperature in the reheating step exceeds the γ' phase solvus temperature. Considering that the γ' phase solvus temperature for the alloy having the above-described composition is about 1,160° C., the temperature range for the reheating in this step is preferably 1,135 to 1,160° C. The time for retaining the hot-worked material at the reheating temperature may be at least about 10 minutes, by which the effect of improving the hot workability can be shown. As the retention time becomes longer, the recrystallization progresses more and the workability improves more; however, an upper limit of the retention time is preferably 24 hours so as to prevent coarsening of the γ matrix grains.

Cooling Step

The reheated material obtained in the reheating step is cooled down to a temperature for the following second hot working step. In this step, if any fine γ' precipitate is formed during the cooling, the hot workability may remarkably degrade. To prevent this, the cooling rate is at most 0.03°

C./second. Thus, the γ' phase grows during the cooling, thus fine precipitation can be suppressed, and thereby excellent hot workability can be obtained. As the cooling rate becomes lower, the γ' phase grows more and the particle size grows more, and it becomes more advantageous in improving the hot workability. The cooling rate is preferably at most 0.02° C./second and more preferably at most 0.01° C./second. The cooling rate is not particularly limited by a lower limit; however, to prevent coarsening of γ matrix grain size, a lower limit of the cooling rate may be 0.001° C./second.

Considering the efficiency of the production process, it is desirable to cool the material at a cooling rate of at most 0.03° C./second until a predetermined hot working temperature for the second hot working step is achieved and hot working is carried out in this state; however, the present invention is not limited to this. Specifically, the second hot working may be carried out by cooling the material down to room temperature and then increasing the material temperature to a predetermined hot working temperature again. In this case, in the second hot working step, a cooling rate from the predetermined hot working temperature to room temperature may be the cooling rate of at most 0.03° C./second specified above, or alternatively, it may be higher than the specified cooling rate.

Second Hot Working Step

The structure of the Ni-based heat-resistant superalloy having undergone the steps mentioned above has been changed to a hot-worked structure, in which more coarse γ' phases are dispersed, compared with the cast structure of the ingot, and thus, the hot workability has been improved. Accordingly, the material can be deformed more than the deformation in the first hot working step by using various working methods such as press forging, hammer forging, rolling, and extrusion. The working temperature in the second hot working step may be in a range of 700 to 1,125° C. Because of the improved hot workability, working in the second hot working step can be performed at a temperature lower than the temperature in the first hot working step. An upper limit of the working temperature in the second hot working step is the same as that of the first hot working step. This is because as the amount of deformation occurring due to the working becomes larger, the increase of temperature occurring due to the working heat generation becomes greater, and thus, the threat of incipient melting may remain. Hot-die forging or superplastic forging may be adopted as a working method for obtaining a disk material for aircraft engines and gas turbines.

EXAMPLES

Example 1

An ingot of a Ni-based heat-resistant superalloy having a chemical composition shown in Table 1 with the weight of 10 kg was prepared by vacuum melting, which is called "material to be hot-worked A". The dimension of the ingot of Ni-based heat-resistant superalloy was about 80 mm×90 mm×150 mmL.

The test pieces were sampled from the ingot of Ni-based heat-resistant superalloy mentioned above, were treated in 8 combinations of the heating step(s) and the cooling step shown in Table 2 and then were subjected to high temperature tensile tests. The test piece used for the tests has a parallel portion with a diameter of 8 mm and a length of 24 mmL and had a gauge length of 20 mmL.

TABLE 1

(% by mass)

| | C | Al | Ti | Cr | Co | Mo | W | B | Zr |
|---|---|---|---|---|---|---|---|---|---|
| Material to be hot-worked A | 0.0155 | 2.50 | 4.88 | 13.48 | 14.93 | 2.99 | 1.24 | 0.030 | 0.034 |

* The balance is Ni with inevitable impurities.

TABLE 2

| Test No. | First heating step | Cooling condition | Second heating step | Reduction of area (%) | Note |
|---|---|---|---|---|---|
| 1 | 1200° C. × 4 hrs | 0.01° C./sec | N/A | 65.2 | Example |
| 2 | 1150° C. × 4 hrs | 0.03° C./sec | N/A | 66.1 | |
| 3 | 1200° C. × 4 hrs | 0.03° C./sec | 1050° C. × 4 hrs | 65.3 | |
| 4 | 1180° C. × 4 hrs | 0.03° C./sec | 1050° C. × 4 hrs | 60.2 | |
| 5 | 1150° C. × 4 hrs | 0.03° C./sec | 1050° C. × 4 hrs | 79.2 | |
| 11 | 1200° C. × 4 hrs | 3° C./sec | N/A | 4.0 | Comparative Example |
| 12 | 1150° C. × 4 hrs | 3° C./sec | N/A | 11.7 | |
| 13 | 1100° C. × 4 hrs | 0.03° C./sec | N/A | 51.0 | |

The hot workability was evaluated from reduction of area in the high temperature tensile test. The results are shown in Table 2. The test temperature was set at 1,000° C., at which the working is relatively difficult, whereas the hot working temperature for the alloy according to the present invention is in a range of about 1,000 to 1,100° C., and the strain rate was 1.0/second. Under these conditions, when a value of reduction of area exceeds 60%, it may be determined that the hot workability is excellent.

As shown in Table 2, Tests Nos. 1 and 2 as Examples of the present invention, which were heated only in the first heating step, had a reduction of area of greater than 60%, because the cooling rate was sufficiently low. Tests Nos. 3 to 5, which were cooled in the cooling step down to 800° C. and then were subjected to the second heating step, had the excellent hot workability. In particular, a comparison between Tests Nos. 2 and 5 shows that the reduction of area was greatly improved by performing the second heating step, and thus, it is effective to perform the second heating step.

Tests Nos. 11 and 12 are Comparative Examples in the case in which the cooling rates were high and each showed an extremely small reduction of area, and thus, it is determined that the hot workability is difficult. In addition, Test No. 13 is a Comparative Example in the case in which the temperature in the first heating step was lower than the temperature range according to the present invention. Test No. 13 showed a higher reduction of area than those of Tests Nos. 11 and 12 because of the low cooling rate, but the hot workability was insufficient. It is presumed that solidification segregation was not sufficiently reduced because the heating temperature was low.

Figure 1B:
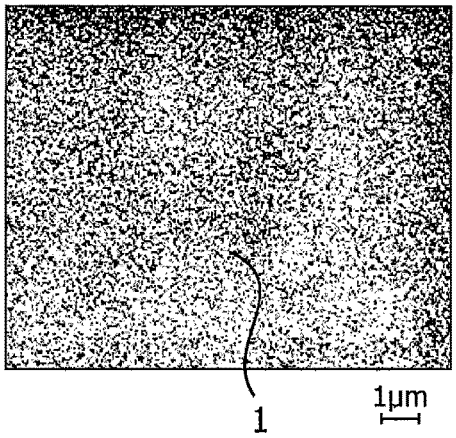

The hot workability of the Examples was obviously different from that of the Comparative Examples even in view of the metal structures of the materials. FIGS. 1(A) and 1(B) are scanning electron microscope photographs showing the metal structures of Tests Nos. 2 and 12 before being subjected to the high temperature tensile test. Test No. 2 as an Example of the present invention had the structure in which the primary γ' phases were formed and grown during the cooling because the cooling rate was low. In such a structure, there is a small amount of fine precipitates, which inhibits the movement of transposition, and thus, the hot workability is excellent. In contrast, in the structure of Test No. 12 as a Comparison Example, the fine primary γ' phases were homogeneously dispersed and precipitated. Such a structure is effective in increasing the strength of the alloy, but it is not preferable for hot working.

Image analysis was performed for the structure photographs shown in FIG. 1 to determine the average particle size of the primary γ' phase. As a result, the average particle size in Test No. 2 was 740 nm, but the average particle size in Test No. 12 was 110 nm. The average particle size of γ' phases in a specific visual field was determined by the following relational expression (1).

$$\pi(d/2)^2=S/n \quad (1)$$

π: Circular constant
d: Average particle size
S: Total area of γ' phase
n: Number of γ' phases In all of Tests Nos. 1 to 5, the primary γ' phases were precipitated with the average particle size of more than 500 nm, and the reduction of area of more than 60% were obtained, thus showing excellent hot workability.

Example 2

As the material to be hot-worked simulating the intermediate material for the hot working, an ingot of a Ni-based heat-resistant superalloy with a weight of 10 kg was produced by vacuum melting, similarly to Example 1, and then materials to be hot-worked B and C were prepared by hot press forging, which were reduced by about 20%. The chemical compositions were as shown in Table 3 (note that the balance included Ni and impurities). These stocks were subjected to press-forging, and in this state, test pieces were sampled therefrom after performing the heating step similarly to Tests Nos. 5 and 12 in Table 2 were evaluated for the hot workability by performing high temperature tensile tests at 1,000° C. under the same conditions as those in Example 1. The results are shown in Table 4.

TABLE 3

(% by mass)

| | C | Al | Ti | Cr | Co | Mo | W | B | Zr |
|---|---|---|---|---|---|---|---|---|---|
| Material to be hot-worked B | 0.0123 | 2.40 | 6.01 | 14.30 | 21.56 | 2.73 | 1.10 | 0.014 | 0.050 |
| Material to be hot-worked C | 0.0150 | 2.38 | 6.10 | 13.36 | 25.20 | 2.81 | 1.17 | 0.014 | 0.030 |

* The balance is Ni with inevitable impurities.

TABLE 4

| Test No. | Stock | First heating step | Cooling condition | Second heating step | Reduction of area (%) | Note |
|---|---|---|---|---|---|---|
| 21 | Material to be hot-worked B | 1150° C. × 4 hrs | 0.03° C./sec | 1050° C. × 4 hrs | 86.5 | Example |
| 22 | Material to be hot-worked C | 1150° C. × 4 hrs | 0.03° C./sec | 1050° C. × 4 hrs | 82.1 | |
| 31 | Material to be hot-worked B | N/A (as press-forged) | | | 38.6 | Comparative Example |
| 32 | Material to be hot-worked B | 1150° C. × 4 hrs | 3° C./sec | N/A | 34.9 | |
| 33 | Material to be hot-worked C | 1150° C. × 4 hrs | 3° C./sec | 1050° C. × 4 hrs | 45.5 | |

As shown in Table 4, for Tests Nos. 21 and 22, the values of the reduction of area for both tests were high, and the hot workability was determined to be excellent. In Test No. 31 of the Comparative Example, which was carried out without performing any heating process, the reduction of area of 60% was obtained, and it was observed that the hot workability had degraded due to the strain accumulated due to the preliminary working. By applying the production method of the present invention, the hot workability was greatly improved.

In Tests Nos. 32 and 33 as Comparative Examples, the strain accumulated in the preliminary working should have been eliminated because the temperature in the first heating step was sufficiently high at 1,150° C., but sufficient hot workability could not be obtained because the subsequent cooling rate was high so that the fine γ' phases were precipitated.

Example 3

To examine the effect of the present invention by using a larger Ni-based heat-resistant superalloy ingot, a Ni-based heat-resistant superalloy ingot having a chemical composition shown in Table 5 was prepared by using the vacuum arc remelting method, which is an industrial melting method, and the material D to be hot-worked was prepared. This large Ni-based heat-resistant superalloy ingot had a columnar shape with the dimension of about the 440 mm (diameter)×1,000 mmL, and the weight was about 1 ton.

The Ni-based heat-resistant superalloy ingot of the material D to be hot-worked was subjected to three types of heating steps shown in Table 6, and then high temperature tensile tests were performed.

TABLE 5

| | C | Al | Ti | Cr | Co | Mo | W | B | Zr |
|---|---|---|---|---|---|---|---|---|---|
| | | | | | | | | (% by mass) | |
| Material to be hot-worked D | 0.014 | 2.31 | 6.33 | 13.48 | 24.04 | 2.91 | 1.18 | 0.02 | 0.04 |

* The balance is Ni with inevitable impurities.

TABLE 6

| Test No. | Heating step | Cooling condition | Second heating step | Cooling condition | Reduction of area (%) | Note |
|---|---|---|---|---|---|---|
| 41 | 1180° C. × 30 hrs | 0.03° C./sec | N/A | N/A | 60.5 | Example |
| 42 | 1180° C. × 30 hrs | 0.03° C./sec | 1150° C. × 20 hrs | 0.03° C./sec | 75.9 | |
| 43 | 1180° C. × 30 hrs | 0.03° C./sec | 1150° C. × 60 hrs | 0.03° C./sec | 98.1 | |

An appropriate range of the hot working temperature for the alloy of the present invention is from 1,000 to 1,100° C., and thus, under the conditions of a typical temperature of 1,050° C., and the strain rate of 0.1/second, the hot workability was evaluated by the reduction of area by tensile tests. The results are shown in Table 6. As shown in Table 6, in Test No. 41, heat treatment was carried out as the first heating step at the temperature of 1,180° C. for 30 hours, and then the cooling treatment was performed at the cooling rate of 0.03° C./second, and as a result of the reduction of area at the test temperature of 1,050° C., a relatively excellent hot ductility was shown. Accordingly, it was observed that excellent results were obtained for a large-size Ni ingot produced by the vacuum arc remelting method by controlling the cooling rate to be low.

In Test No. 42, after performing the heating step and cooling step similar to those in Test No. 41, heat treatment was performed as the second heating step at the temperature of 1,150° C. for 20 hours, and then cooling was performed at the cooling rate of 0.03° C./second, and as a result of the reduction of area, excellent hot workability was shown, which was better than the hot workability in Test No. 41. In Test No. 43, after performing the heating step and cooling step similar to those in Test No. 41, heat treatment was performed as the second heating step at the temperature of 1,150° C. for 60 hours, and then cooling was performed at the cooling rate of 0.03° C./second, a reduction of area of more than 95% was obtained, and as a result, highly superior hot workability was shown.

As shown by the results of Tests Nos. 42 and 43, the hot workability further improved by adding the second heating step. This was because a temperature equal to or lower than the γ' phase solvus temperature and at which the distribution of the atoms would be active was selected as the second heating step and by performing the heat treatment for a long time at the selected temperature, the coarse γ' phase obtained by the cooling treatment after the heating step could be allowed to grow into a further larger γ' phase.

Figure 2:
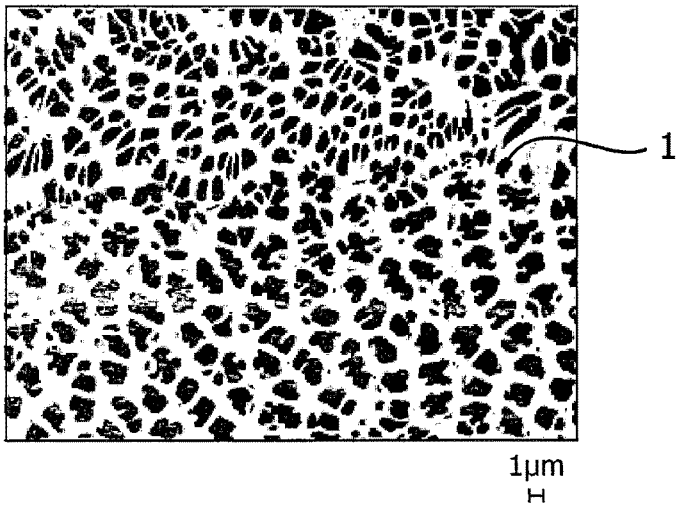
FIG. 2 is an electron microscope photograph showing a metal structure of an Example of a Ni-based heat-resistant superalloy according to the present invention.
Figure 3:
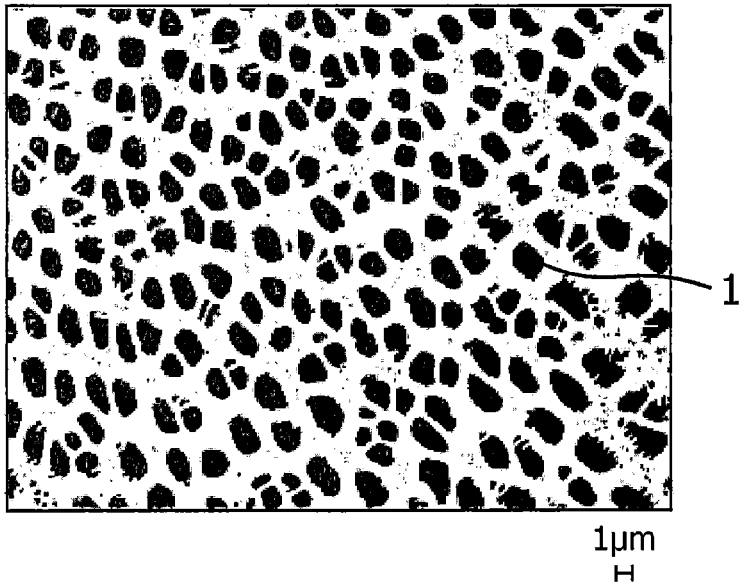
FIG. 3 is an electron microscope photograph showing a metal structure of an Example of a Ni-based heat-resistant superalloy according to the present invention.

FIGS. 2 and 3 are reflection electronic image captured by a scanning electron microscope, which shows the metal structure before the high temperature tensile tests in Tests Nos. 41 and 42. It was observed that in Test No. 41, a coarse γ' phase of 500 nm or more was obtained, while in Test No. 42, the γ' phase had grown into a further larger primary γ' phase of 1 μm or larger.

Example 4

In order to further examine the effects of the present invention, a large ingot of a Ni-based heat-resistant superalloy having the chemical composition of Example 3 shown in Table 5 was subjected to the heating step and the cooling step similar to those in Test No. 43 shown in Table 6, and then was shaped by hot forging using a press machine by an industrial hot working method.

The size of the columnar ingot was about 440 mm (diameter)×1,000 mmL similarly to Example 3, and the weight was about 1 ton. The γ' phase solvus temperature for the alloy of the present invention was about 1,160° C.

Figure 4:
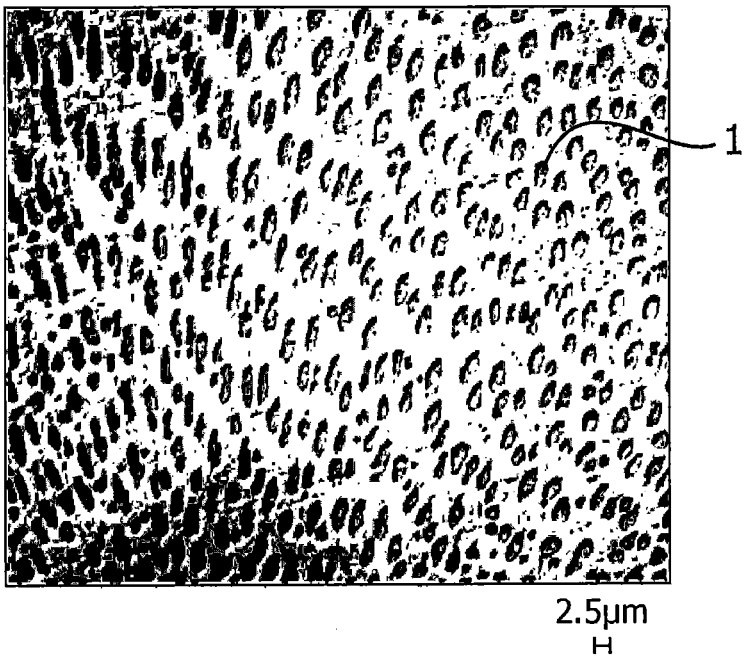
FIG. 4 is an electron microscope photograph showing a metal structure of an Example of a Ni-based heat-resistant superalloy according to the present invention.

FIG. 4 shows an optical microscope photograph of the metal structure of the material having undergone the first heating step, the second heating step, and the cooling step. The same effects as those obtained in Example 3, i.e., effects such that the γ' phase grew into a coarse phase during the slow cooling at the cooling rate of 0.03° C./second performed after the first heating step and that in the second heating step, the γ' phase was further coarsened by the heating at 1,150° C., which is a temperature below the solvus temperature, can be verified by the fact that size of the γ' phase is 1 μm or larger also in the large ingot.

The ingot of the material to be hot-worked was heated to 1,100° C., i.e., the hot working temperature, and upset forging was performed at the hot working ratio of 1.33. As a result, in the material to be hot-worked having undergone the upset forging, no cracking occurred on the surface and in the inside, and it was shown that excellent hot workability was obtained.

Example 5

An ingot of a Ni-based heat-resistant superalloy having a chemical composition shown in Table 7 with a weight of 10 kg was prepared by vacuum melting. The dimension of the Ni-based heat-resistant superalloy ingot was about 80 mm×90 mm×150 mmL. This ingot was subjected to a heat treatment at 1,200° C. for 20 hours as a homogenization heat treatment. From this ingot, a test piece having a parallel portion with the dimension of 8.0 (diameter)×24 mm was sampled, the test piece was worked and subjected to the first hot working step, the reheating step, the cooling step, and the second hot working step as shown in Table 8.

In the first hot working step, the test piece was subjected to tensile deformation equivalent to the hot working ratio of 1.1 at the strain rate of 0.1/second. In the reheating step, the test piece was heated from 1,100° C. up to 1,150° C. or 1,135° C., and was retained for 20 minutes. After the retention, the test piece was cooled by the cooing step down to 1,100° C. at the cooling rate of 0.03° C./second, and the second hot working step was carried out. In the second hot working step, as the high temperature tensile test, tensile deformation was performed at 1,100° C. and at the strain rate of 0.1/second until the material broke. As the index for the hot workability, the reduction of area after the high temperature tensile test was measured. The results are shown in Table 8.

As the Comparative Example, test pieces were subjected to the respective steps under the conditions similar to those in the Example, except that the temperature for the reheating step was 1,100° C. and the cooling treatment was not performed, and high temperature tensile tests were carried out. The results are also shown in Table 8.

TABLE 7

(% by mass)

| Ingot No. | C | Al | Ti | Cr | Co | Mo | W | B | Zr |
|---|---|---|---|---|---|---|---|---|---|
| A | 0.015 | 2.29 | 6.01 | 13.16 | 23.83 | 2.76 | 1.13 | 0.01 | 0.03 |

* The balance is Ni with inevitable impurities.

TABLE 8

| Test No. | Group | First hot working step | Reheating step | Cooling step | Second hot working step | Reduction of area (%) |
|---|---|---|---|---|---|---|
| 51 | Example | 1100° C. | 1150° C. × 20 min | 0.03° C./sec | 1100° C. | 48.6 |
| 52 | | 1100° C. | 1135° C. × 20 min | 0.03° C./sec | 1100° C. | 37.8 |
| 53 | Comparative Example | 1100° C. | 1100° C. × 20 min | — | 1100° C. | 29.9 |

For reference, a test piece sampled and worked from Ingot No. A was subjected to the high temperature tensile test under the conditions of a temperature of 1,100° C. and a strain rate of 0.1/second without being subjected to any of steps mentioned above. As a result, the reduction of area was approximately 30%. In contrast, it was observed as shown in Table 2 that Tests Nos. 51 and 52 as Examples each had an improved reduction of area by performing the predetermined steps. In Test No. 51, in which the reheating temperature was higher than that in Test No. 52, more effect for improving the hot workability was obtained. In contrast, in Test No. 53 of the Comparative Example, the temperature for the reheating step was 1,100° C., i.e., the same temperature as the working temperature for the first hot working step, and the reduction of area was substantially the same as that in the cases in which any of the above-described steps were performed. This indicates that recrystallization hardly occurs at the alloy temperature of 1,100° C., and the hot workability is hardly restored if the heating is performed at the hot working temperature. In the Example, recrystallization was allowed to progress by once reheating the material to a temperature higher than the hot working temperature, and it was considered that the hot workability thus improved.

Example 6

Ingots of Ni-based heat-resistant superalloys having chemical compositions shown in Table 9 with each weight of 10 kg were prepared by vacuum melting similarly to Example 5. Ingots No. B and C were subjected to a heat treatment at 1,200° C. for 20 hours as a homogenization heat treatment, and then were subjected to hot forging by press forging at 1,100° C.

TABLE 9

(% by mass)

| Ingot No. | C | Al | Ti | Cr | Co | Mo | W | B | Zr |
|---|---|---|---|---|---|---|---|---|---|
| B | 0.015 | 2.4 | 6.1 | 13.4 | 25.2 | 2.8 | 1.2 | 0.014 | 0.04 |
| C | 0.012 | 2.4 | 6.0 | 14.3 | 21.6 | 2.7 | 1.1 | 0.014 | 0.10 |

* The balance is Ni with inevitable impurities.

To Ingot No. B of the Ni-based heat-resistant superalloy, reduction equivalent to the hot working ratio of 1.2 was performed at 1,100° C. as the first hot working step, and then reheating was performed at 1,150° C. for 4 hours as the reheating step, and cooling was performed at the cooling rate of 0.03° C./second as the cooling step, and press forging was performed on the material again at 1,100° C. as the second hot working step. As a result, the material was hot-forged without any large cracks or laps being generated, and reduction of the material equivalent to the hot working ratio of 2.5 could be performed. Accordingly, in the Example, it was possible to increase the hot working ratio in the second hot working step to double or more than that in the first hot working step.

For the Ni-based heat-resistant superalloy ingot C, as the Comparative Example, the reheating step was not applied and press forging at 1,100° C. was continued. As a result, cracking, occurred on the material when reduction equivalent to the hot working ratio of 1.3 was performed, and hot forging was stopped there.

Figure 5:
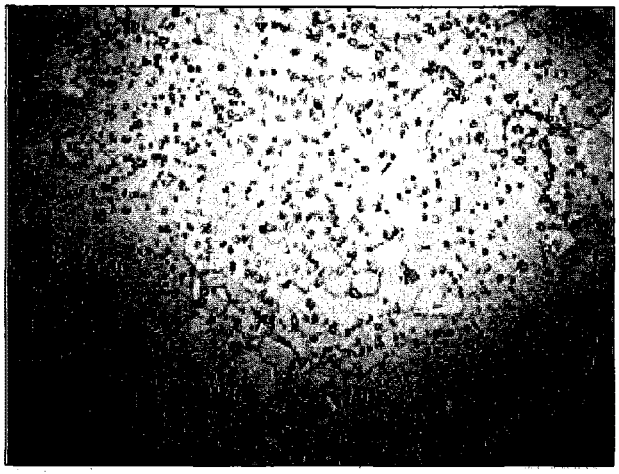
FIG. 5 is an electron microscope photograph showing a metal structure of an Example of a Ni-based heat-resistant superalloy according to the present invention.
Figure 6:
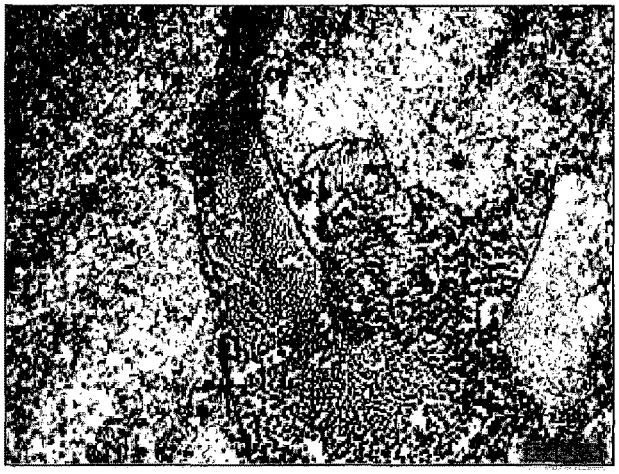
FIG. 6 is an electron microscope photograph showing a metal structure of a Comparative Example of a Ni-based heat-resistant superalloy.

FIG. 5 is an electron microscope photograph showing the metal structure at the stage after the reheating step was performed on Ingot No. B. As shown in FIG. 5, it is observed that a fine forged structure is formed after having undergone the reheating step. FIG. 6 is an electron microscope photograph showing the micro structure after performing the press forging onto Ingot No. C. It was observed as shown in FIG. 6 that recrystallization was insufficient even after strain was imparted by forging, and thus, the cast structure remained.

In the normal hot working step, the working is performed at the temperature at which recrystallization occurs, and thus, the fine forged structure shown in FIG. 5 can be obtained and excellent hot workability can be obtained, whereas in the Ni-based heat-resistant superalloy having the above-described composition, recrystallization hardly occurs in the temperature range for the hot working, and thus, it is difficult to continuously perform the hot working at a constant temperature as described above. It was observed by this test that the hot workability can be dramatically improved by temporarily reheating the material to a temperature range higher than the temperature range for the hot working and thereby reforming the metal structure.

Example 7

To examine the effect of the present invention with respect to a larger Ni-based heat-resistant superalloy ingot, a Ni-based heat-resistant superalloy ingot having a chemical composition shown in Table 10, with dimensions of about 440 mm (diameter)×1,000 mmL, and a weight of about 1 ton, was prepared. This ingot was subjected to hot forging by hot pressing. The γ' phase solvus temperature for Ingot No. D was about 1,160° C.

TABLE 10

(% by mass)

| Ingot No. | C | Al | Ti | Cr | Co | Mo | W | B | Zr |
|---|---|---|---|---|---|---|---|---|---|
| D | 0.014 | 2.31 | 6.33 | 13.48 | 24.04 | 2.91 | 1.18 | 0.02 | 0.04 |

* The balance is Ni with inevitable impurities.

This ingot was heated at the retention temperature of 1,180° C. for a retention time of 30 hours as the homogenization heat treatment in the preparation step before performing the first hot working step, and then, the first heating step in which the ingot was cooled to room temperature at the cooling rate of 0.03° C./second, and next, the ingot was heated at the retention temperature of 1,150° C. for the retention time of 60 hours, and then the second heating step in which the ingot was cooled to room temperature at the cooling rate of 0.03° C./second to obtain a material to be hot-worked. This material to be hot-worked was subjected to free hot forging by using a press by the following method.

First, the material to be hot-worked was subjected to upset forging at the hot working ratio of 1.33 after temporarily heating it to 1,100° C., the first hot working temperature, and then the material was heated up to 1,150° C., and then the reheating step was performed in which the material retained for 5 hours to promote the recrystallization. Subsequently, the reheated material to be hot-worked was cooled down to 1,100° C. at the cooling rate of 0.03° C./second, and then an extended forging operation was performed, by which the diameter was returned to a diameter equivalent to 440 mm.

The material to be hot-worked having been processed in the above-described manner was heated up to 1,150° C. and retained for 5 hours again to promote the recrystallization, and then it was cooled down to 1,100° C. at a cooling rate of 0.03° C./second, and then upset forging was performed at the hot working ratio of 1.33 for the second time. Subsequently, in a similar manner as that performed after the first upset forging, the material was heated up to 1,150° C. and retained for 5 hours again, and then was cooled down to 1,100° C. at the cooling rate of 0.03° C./second, and then the second extend forging operation for returning the diameter to a diameter equivalent to 440 mm was performed.

The material to be hot-worked having been processed in the above-described manner was heated up to 1,150° C. and retained for 5 hours again, then it was cooled down to 1,100° C. at the cooling rate of 0.03° C./second, and then an extended forging operation was performed this time until the final dimension became about 290 mm (diameter)×1,600 mmL to obtain the hot-worked material. In the above-described forging step, the total number of times of heating of the material up to 1,150° C. was four.

By performing the heating step performed at 1,150° C. during the forging step, recrystallization of the metal structure was promoted, and as a result, excellent hot workability was maintained, and even at the initial working stage in which working is more difficult, i.e., at the stage of performing hot working of the ingot having a heterogeneous cast and solidified structure, the hot working could be continued with substantially no cracking on the surface and with no cracking in the inside.

The hot forging was able to be performed on the Ni-based heat-resistant superalloy having such a large amount of γ' phases without causing problems such as laps and cracks because excellent hot workability could be imparted by the hot forging method of the present invention.

Figure 7:
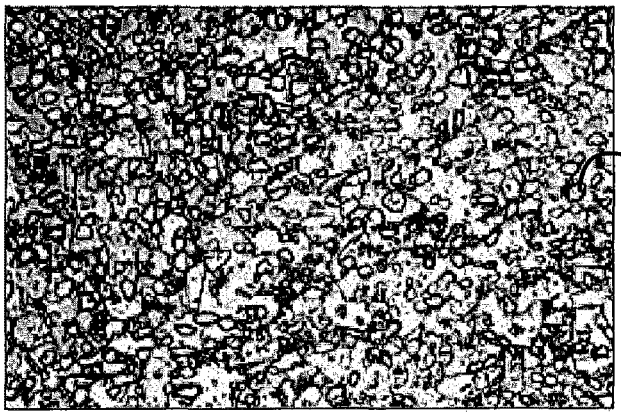
FIG. 7 is an electron microscope photograph showing a metal structure of an Example of a Ni-based heat-resistant superalloy according to the present invention.

Regarding the hot-forged material, an optical microscope photograph of the metal structure on the section located at the depth of ¼ from the surface of the diameter D is shown in FIG. 7. As shown in FIG. 7, it was observed that γ' phases 1 each has a particle size of about 2 μm and that fine γ matrix grains pinned by the γ' phases 1 each has a grain size of about 15 to 25 μm. Thus, it can be seen that an excellent metal structure having fine and homogeneous γ matrix grains can be obtained even by performing an operation for molding a large billet.

With respect to the material for use in aircraft engines and power generation gas turbines, as the member that uses the material to be exposed to high temperatures and high voltages is more important, it is required that the material have a higher strength, and thus, a Ni-based heat-resistant superalloy with a large amount of precipitation of the γ' phases is used for the material. The hot workability of the Ni-based heat-resistant superalloy with a large amount of precipitation of the γ' phase is generally extremely low, and therefore it is difficult to supply such Ni-based heat-resistant superalloy stably at low costs. However, it is shown that such a Ni-based heat-resistant superalloy can be stably supplied at low costs because by applying the present invention, excellent hot workability can be obtained in the highly strong Ni-based heat-resistant superalloy with a large amount of precipitation of the γ' phase.

As described above, by applying the present invention, remarkable improvement of hot workability can be observed, and thus, the amount of hot working per one operation increases, and as a result, it is expected that the operation efficiency can be dramatically improved. Because of this effect of the present invention, the energy and the operation time required for the working can be reduced, and in addition, the working can be done within less operation time, and as a result, it can be expected that degradation of the yield, which may be caused due to oxidation of the surface of the material to be hot-worked, can be suppressed.

INDUSTRIAL APPLICABILITY

The Ni-based heat-resistant superalloy production method of the present invention can be applied in producing forged parts for aircraft engines and power generation gas turbines, particularly in producing very strong alloys used for turbine disks.

LIST OF REFERENCE SYMBOLS

1: γ' phase

The invention claimed is:

1. A method for producing a Ni-based heat-resistant superalloy, the method comprising the steps of:

providing a material to be hot-worked having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% B, 0.001 to 0.1% Zr, and the balance of Ni with inevitable impurities;

heating the material to be hot-worked in a temperature having a range of 1,130 to 1,200° C. for at least 2 hours;

cooling the material to be hot-worked heated by the heating step to a hot working temperature or less at a cooling rate of at most 0.03° C./second; and subjecting the material to be hot-worked to hot working after the cooling step.

2. The method for producing a Ni-based heat-resistant superalloy according to claim 1, further comprising a second heating step for heating the material to be hot-worked in a temperature that has a range of 950 to 1,160° C. and is lower than the temperature performed by the first heating step for at least 2 hours after or during the cooling step.

3. The method for producing a Ni-based heat-resistant superalloy according to claim 1, wherein the material to be hot-worked has a composition consisting of, by mass, 0.005 to 0.04% C, 1.5 to 3.0% Al, 5.5 to 6.7% Ti, 13 to 16% Cr, 20 to 27% Co, 2.0 to 3.5% Mo, 0.7 to 2.0% W, 0.005 to 0.04% B, 0.005 to 0.06% Zr, and the balance of Ni with inevitable impurities.

4. The method for producing a Ni-based heat-resistant superalloy according to claim 1, wherein the material to be hot-worked has a composition consisting of, by mass, 0.005 to 0.02% C, 2.0 to 2.5% Al, 6.0 to 6.5% Ti, 13 to 14% Cr, 24 to 26% Co, 2.5 to 3.2% Mo, 1.0 to 1.5% W, 0.005 to 0.02% B 0.010 to 0.04% Zr, and the balance of Ni with inevitable impurities.

5. A method for producing a Ni-based heat-resistant superalloy, the method comprising the steps of:

heating an ingot having a composition consisting of, by mass, 0.001 to 0.05% C, 1.0 to 4.0% Al, 4.5 to 7.0% Ti, 12 to 18% Cr, 14 to 27% Co, 1.5 to 4.5% Mo, 0.5 to 2.5% W, 0.001 to 0.05% B, 0.001 to 0.1% Zr, and the balance of Ni with inevitable impurities in a hot working temperature having a range of 800 to 1,125° C. and subjecting the resulting ingot to first hot working at a hot working ratio of 1.1 to 2.5 to provide a hot-worked material;

reheating the hot-worked material in a temperature range that is higher than the temperature performed at the first hot working and is lower than a γ' phase solvus temperature to provide a reheated material;

cooling the reheated material to a temperature having a range of 700 to 1,125° C. at a cooling rate of at most 0.03° C./second; and performing second hot working after the cooling step.

6. The method for producing a Ni-based heat-resistant superalloy according to claim 5, wherein the ingot has a composition consisting of, by mass, 0.005 to 0.04% C, 1.5 to 3.0% Al, 5.5 to 6.7% Ti, 13 to 16% Cr, 20 to 27% Co, 2.0 to 3.5% Mo, 0.7 to 2.0% W, 0.005 to 0.04% B, 0.005 to 0.06% Zr, and the balance of Ni with inevitable impurities.

7. The method for producing a Ni-based heat-resistant superalloy according to claim 5, wherein the ingot has a composition consisting of, by mass, 0.005 to 0.02% C, 2.0 to 2.5% Al, 6.0 to 6.5% Ti, 13 to 14% Cr, 24 to 26% Co, 2.5 to 3.2% Mo, 1.0 to 1.5% W, 0.005 to 0.02% B, 0.010 to 0.04% Zr, and the balance of Ni with inevitable impurities.

8. The method for producing a Ni-based heat-resistant superalloy according to claim 5, wherein the temperature for the reheating step has a range of 1,135° C. to 1,160° C.

* * * * *